US009999838B1

(12) United States Patent
Hartelius et al.

(10) Patent No.: US 9,999,838 B1
(45) Date of Patent: Jun. 19, 2018

(54) STEP OPERATED WATER FLOW CONTROL VALVE

(71) Applicants: Mark Ellard Hartelius, Orland Park, IL (US); Kimberlee Wilkens, Palos Park, IL (US)

(72) Inventors: Mark Ellard Hartelius, Orland Park, IL (US); Kimberlee Wilkens, Palos Park, IL (US)

(73) Assignee: HARTDESIGN Ltd., Chicago, IL (US)

( * ) Notice: Subject to any disclaimer, the term of this patent is extended or adjusted under 35 U.S.C. 154(b) by 0 days. days.

(21) Appl. No.: 15/652,524

(22) Filed: Jul. 18, 2017

Related U.S. Application Data

(60) Provisional application No. 62/339,024, filed on May 19, 2016.

(51) Int. Cl.
*A63G 21/18* (2006.01)
*B05C 5/02* (2006.01)
*B05B 12/00* (2018.01)

(52) U.S. Cl.
CPC ..... *A63G 21/18* (2013.01); *B05C 5/0225* (2013.01)

(58) Field of Classification Search
CPC ..... A63G 21/00; A63G 21/18; A63G 31/00; A63G 31/007; A63B 2009/008; A63H 23/00; A63H 23/10; A63H 23/16; B05B 1/3006; B05B 1/323; B05B 1/20; F02M 61/18
USPC ..... 472/116, 117, 128; 446/153, 475; 239/533.1, 533.13, 537, 538
See application file for complete search history.

(56) References Cited

U.S. PATENT DOCUMENTS

| | | | | |
|---|---|---|---|---|
| 5,401,214 A * | 3/1995 | Smollar | A63G 21/18 446/489 |
| 2005/0181882 A1* | 8/2005 | Sanchez | A63G 21/18 472/117 |
| 2010/0285893 A1* | 11/2010 | Leimone | A63G 21/18 472/117 |
| 2011/0105238 A1* | 5/2011 | Amron | A63H 23/10 472/128 |

* cited by examiner

*Primary Examiner* — Kien Nguyen
(74) *Attorney, Agent, or Firm* — Robert W. J. Usher

(57) ABSTRACT

A portable childrens' water slide apparatus having a water slide with an elongate plastic sheet extending horizontally along the ground between entry and exit ends and, a water chamber extending along one edge of the sheet with an inlet and outlet jets for spraying water over the sheet. A delayed return, flow control valve coupled between the chamber and a water hose has a valve actuating member with a horizontal, step-on panel movable between an upper, throttling position and a depressed, unthrottling position when stepped on before entering the slide. A spring biases the panel upwards. A valve body has a flow control member linked to the panel for movement to an unthrottling position by depression by a child stepping thereon, permitting a maximum water flow to the slide during sliding; and a device delays return of the flow control member to the throttling position after stepping off the panel.

12 Claims, 6 Drawing Sheets

STEP OPERATED WATER FLOW CONTROL VALVE

FIELD OF THE INVENTION

The invention relates to water using play apparatus such as childrens' water slides and sprinklers and to a flow control valve thereof controlling the flow of water thereto and, more particularly, to such valve with a step operated actuating member positioned in the path of a child user approaching the slide entrance so that the actuating member is normally stepped on by the child user to effect valve operation permitting an increase in water flow when a child is actually on the slide or under the sprinkler.

BACKGROUND OF THE INVENTION

Many states and countries are suffering from water shortages—while use of water toys that require a flow of water to interact with the child are still desired. Apparatus such as slides that need water sprayed on them to work well, require a lot of water.

It is therefore desirable to reduce or minimize the water supplied when the person is not actually on the slide.

SUMMARY OF THE INVENTION

Accordingly, the invention provides a valve actuating member comprising a step-on panel connected to open the valve fully for water to flow at full, (necessary for play), pressure during actual use, (e.g. contact with the child), but which is biased (e.g. spring loaded) to return automatically to a throttling position permitting water flow at only a much reduced rate, (approximately 30% of the fully open rate), for intervals between the often short periods of actual use of the apparatus. The valve has a damper on it to slowly close after preselected periods of time such as 5 to 8 seconds or 30 to 60 seconds, corresponding to the maximum duration of each period of actual use.

PARTICULAR DESCRIPTION

Figure 2A:
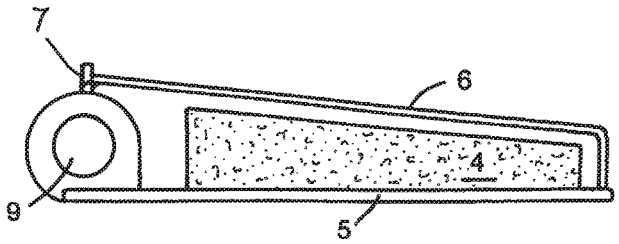
FIGS. 2A and 2B are schematic sectional views of the actuating/operating member prior to and during step-on operation, respectively.
Figure 2B:
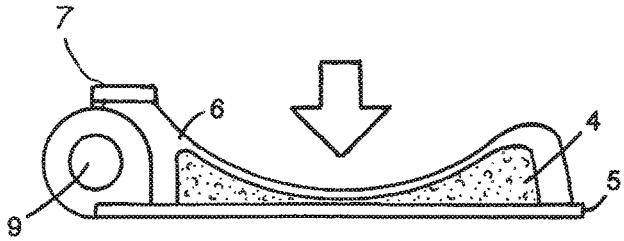
Figure 1:
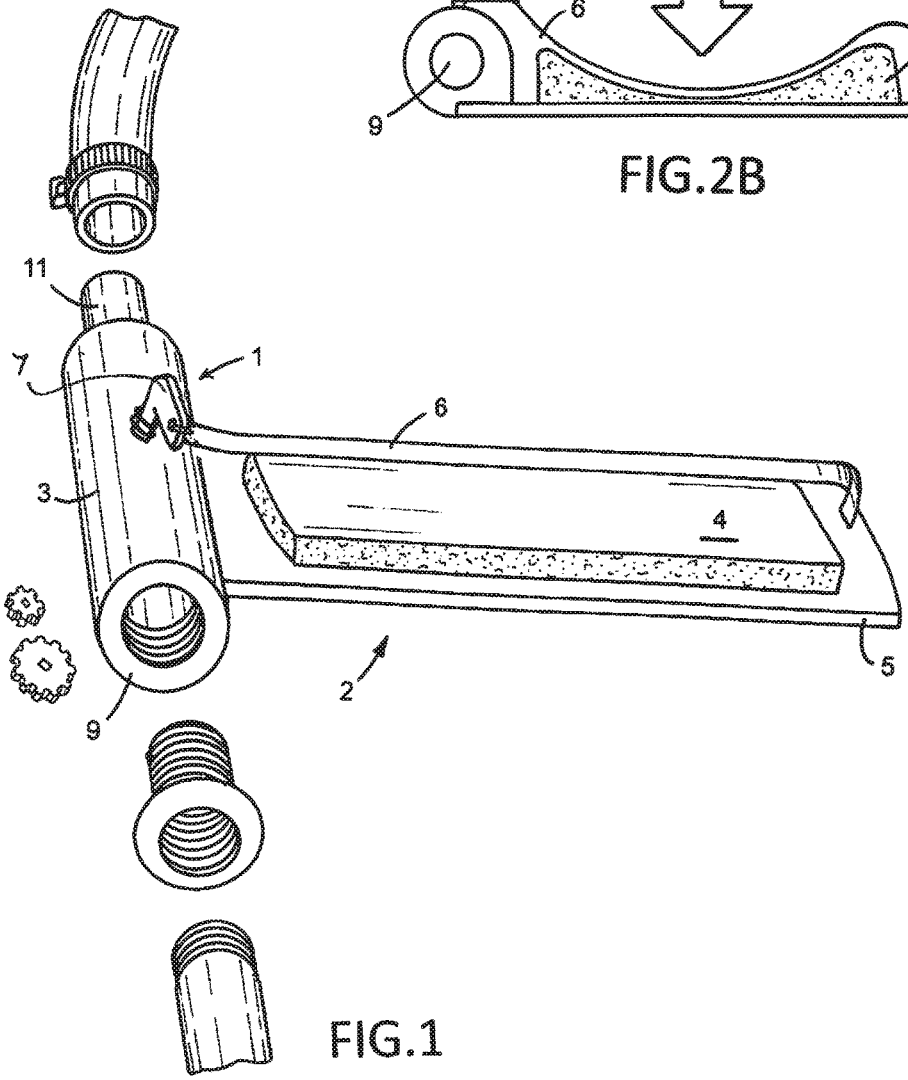
FIG. 1 is a schematic, perspective of a flow control valve with an actuating member, according to the invention.
Figure 4:
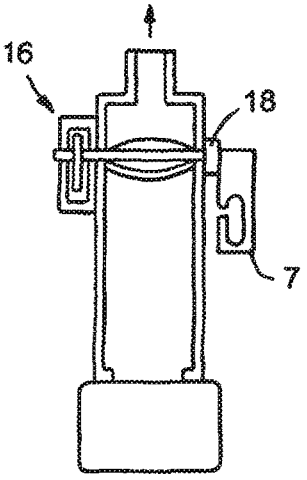
FIG. 4 is a schematic sectional view of a butterfly valve of the apparatus.
Figure 3:
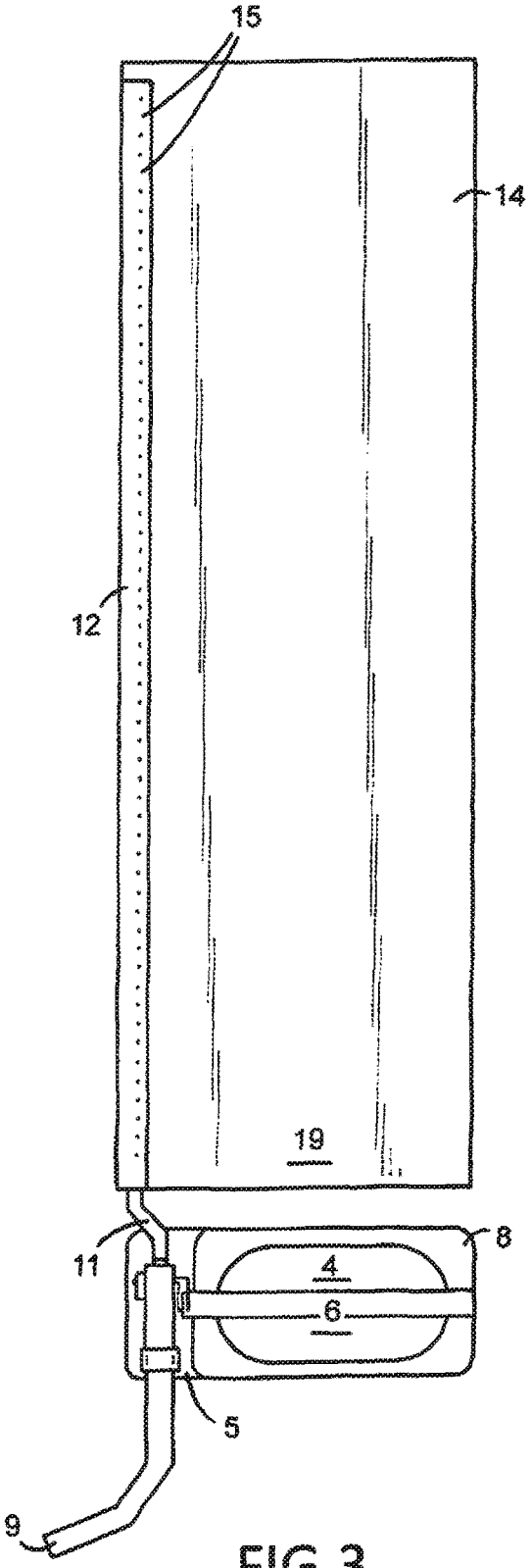
FIG. 3 is a schematic plan view of a portable water slide apparatus incorporating the flow control valve.
Figure 5:
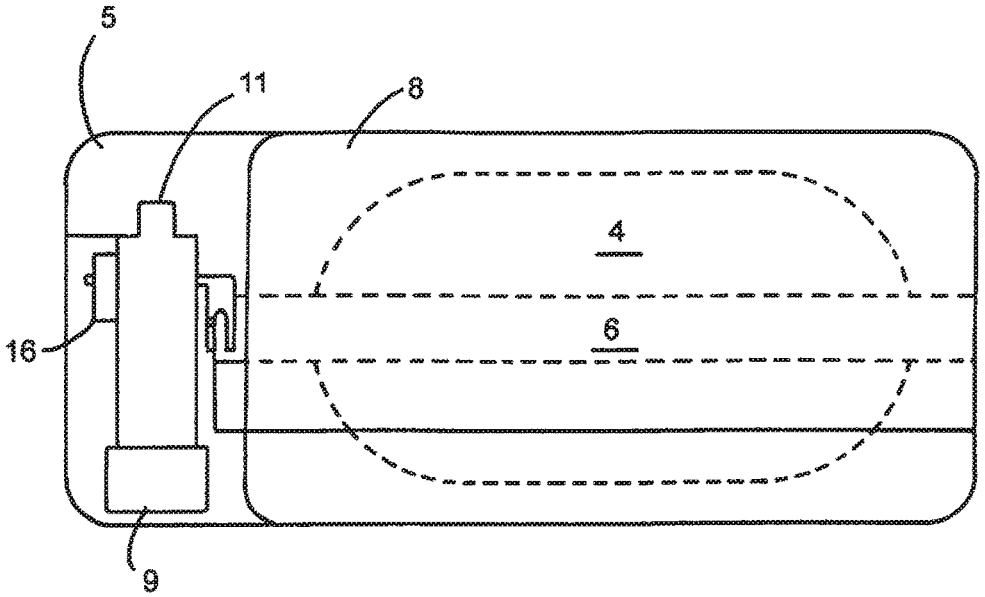
FIG. 5 shows the panel-form actuating member of FIG. 3 at a larger scale.
Figure 6:
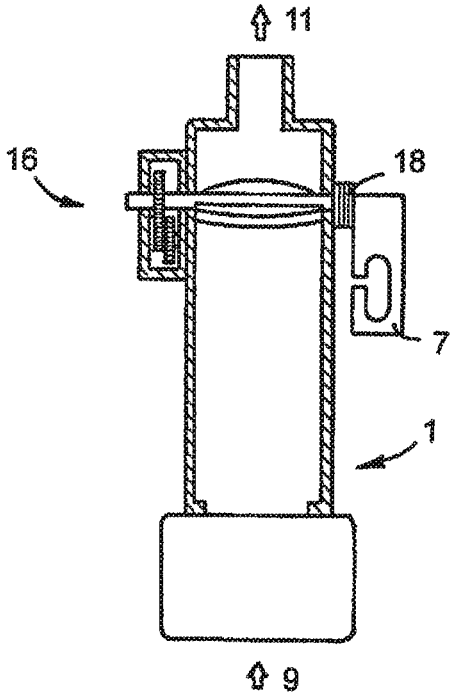
FIG. 6 is a schematic view of the valve body at a larger scale.

Referring to FIGS. 1-6, a first embodiment of butterfly valve 1 has a panel-form actuating member 2 operatively attached along a longitudinal side of a cylindrical valve body 3 to extend transversely therefrom. The actuating member comprises a layer of resiliently compressible foam 4 contained between a stiff basal sheet 5 of PP and a top, flexible, cover sheet 8 of PVC, (not shown in FIGS. 1-2B). A nylon strap 6 has one end attached to a distal portion of the basal sheet 5, extends over the top of the foam, (and concealed under the top cover), to an opposite end attached to an cranked actuating arm/stem 7 of the butterfly valve 1.

An inlet end 9 of the valve body 3 connects to an 'always on' water supply (garden hose) while the outlet end 11 connects to a PVC, tube-form chamber 12 extending along one longitudinal edge of a PVC sheet forming a water slide 14. The tubular chamber has a series of perforations/jet outlets 15 along its length to spray water onto the surface of the slide.

The butterfly valve 1 mounts a return spring 18 operatively connected between the free end of the cranked actuating arm/stem 7 and the valve body to bias the valve in a (partially) closed, throttling position and, a gear mesh 16 of large and small gears (preferably immersed in a viscous liquid such as oil) which functions with a damping action to delay the return of the nylon strap 6 to a straight, fully extended, position of maximum effective length and therefore the return of the valve member to the throttling position.

The foam pad 4 extends approximately 9 inches (across the pathway to the slide) and 5 inches along the pathway so that it can completely accommodate/engage the foot and therefore the entire weight of a small child stepping thereon when running to the slide, while the cover is 11 inches by 6 inches accommodating some overlap, and the overall dimensions of the valve are 14 inches by 6 inches ensuring portability in combination with the slide 14.

When the slide is not in use, the foam 4 will be in uncompressed condition and the nylon strap will be fully extended, enabling the valve to be partly closed by the return spring 18 to allow only 30% of the maximum flow needed for optimal sliding. The location/position and platform-like panel structure of the valve actuating member assures that a child user approaching the entry end 19 of the slide will normally inevitably step on the panel compressing the foam and depressing the nylon strap to reduce the effective length, so pulling the crank to open the valve, permitting the water flow there-through to increase for optimal sliding.

The gear based damper delays return of the valve to the throttling state until a solitary user has reached the end of the slide—and must return to the entry end and step on the panel to trigger optimal water flow.

Figure 7:
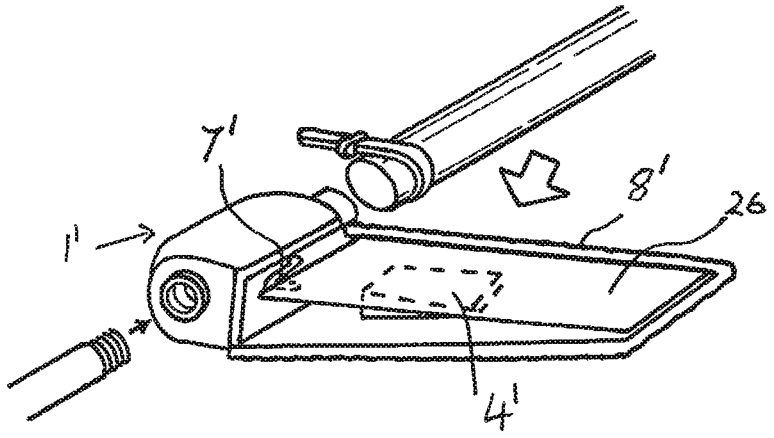
FIG. 7 is a schematic perspective of a second embodiment of flow control valve with an actuating member, according to the invention.
Figure 8:
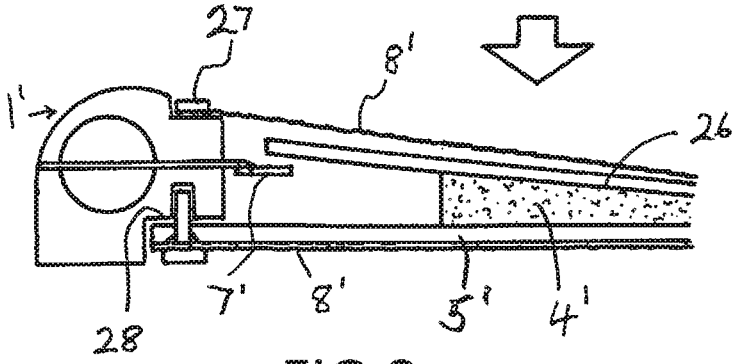
FIG. 8 is a schematic fragmentary view of the second embodiment shown in FIG. 7.

In a second embodiment shown in FIGS. 7 and 8, although the panel remains substantially horizontal, an inclined, rigid sheet/panel 26 of ABS having a raised end aligned over the free end of the cranked valve stem 7' replaces the flexible strap of the first embodiment. The foam 4 is a 'slow foam' adhered to the rigid panel 26 and to the PP base 5'. The subassembly, is enclosed in a sleeve/bag-form, vinyl housing 8' attached by a strap 27 extending around a ledge 28 on the adjacent elongate side of the valve housing body 3'. The weight of a child stepping onto the actuating member depresses the raised portion of the panel toward the horizontal, compressing the 'slow foam' and depressing the free end of the crank arm to open the valve admitting increased water flow to the slide. The slow return property of the foam maintains the sheet/panel 26 in engagement with the free end of the crank for an extended period, opposing the return action of any biasing spring and, therefore, maintaining the valve more open for a predetermined extended period of time.

Figure 9A:
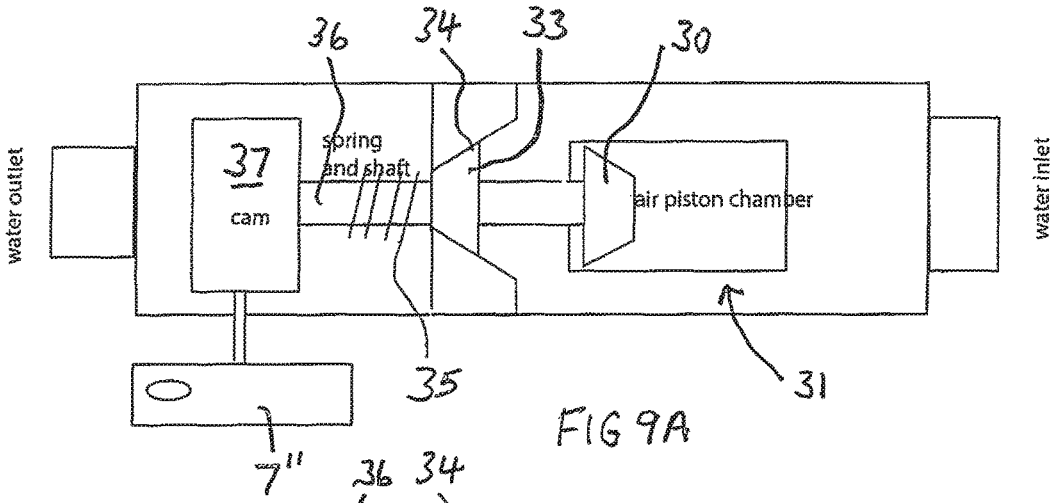
FIGS. 9A and 9B are schematic sectional views of a third embodiment of valve in closed (throttling) and open positions, respectively.
Figure 9B:
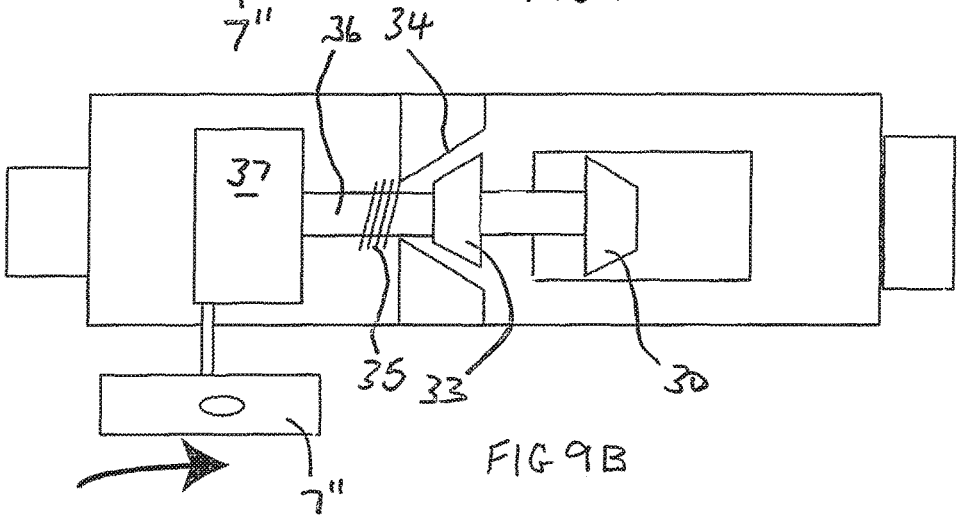

In a third embodiment shown in FIGS. 9A and 9B, a metered flow valve of the prior art replaces the butterfly valve.

The slow return is provided by a piston 30 in a sealed air cylinder 31 having a conical valve member/piston 33 carried by piston rod 36 and normally biased by a piston rod mounted coil spring 35 against a complementary valve seat 34 for complete throttling to prevent water flow, as shown in FIG. 9A. The end of the piston rod rests against a cam 37 coupled to the crank 7"

Treading on the actuating member rotates the crank 7" and thereby the cam 37 to urge the piston rod from the position shown in FIG. 9A to that shown in 9B, compressing the air in the cylinder, compressing the biasing spring and moving valve member 33 away from the valve seat 34 to permit water flow through the valve. The delay is determined by the rate at which the air leaks passed the head of the piston to refill the cylinder 31.

Valves of such type are commonly used in faucets and are sold by Delta Faucet Company of Indianapolis, Ind. (also, London, ON Canada).

The invention claimed is:

1. A portable childrens' water slide apparatus comprising:

a water slide comprising an elongate plastic sheet extending horizontally along the ground with an entry end and an opposite, exit end and, a water supply chamber extending along one longitudinal edge of the sheet and having an inlet for coupling to a water supplying hose and a series of outlet jets for spraying water over an upper, sliding surface of the sheet;

a delayed return, flow control valve coupled between the chamber and the water supply hose and comprising:

a valve actuating member comprising a horizontally extending, step-on panel sufficiently broad to receive a child's foot and movable between an upper, throttling position and a depressed, unthrottling position and positioned in a path of a child approaching the slide entry end so as to normally be stepped on by the child before entering the slide;

a resilient member biasing the panel in the upper position;

a valve body extending transversely from the panel in coplanar relation adjacent the path of entry and having an inlet and an outlet connecting to the hose and the chamber; respectively, a flow control member in the valve body moveable between a throttling and an unthrottling position;

the actuating member being linked to the flow control member to move it to an unthrottling position by the panel being depressed by a child stepping thereon, permitting a maximum water flow to the slide during sliding; and, means for returning the flow control member to the throttling position after a predetermined period of time after stepping off the actuating member corresponding at least to the child reaching the exit end of the slide.

2. Apparatus according to claim 1 wherein the means for returning the flow control mechanism to the throttling position comprises a resilient member.

3. Apparatus according to claim 1 wherein the panel comprises a pad of resiliently compressible foam.

4. Apparatus according to claim 3 wherein the actuating member comprises a flexible strap extending across an upper surface of the foam pad between the flow control member and a remote location of the foam pad for vertical movement from a straight, elevated position to a depressed, curved, unthrottling position with pad depression, by the child stepping on the panel.

5. Apparatus according to claim 3 wherein the panel comprises a rigid board extending across an upper surface of the foam pad between the flow control member and a remote location for vertical movement from an elevated position to a depressed, unthrottling position with pad depression by the child stepping on the panel.

6. A portable, delayed return, flow control valve for coupling between childrens' water using apparatus and a water supply hose and comprising:

a valve actuating member comprising a horizontally extending, step-on panel sufficiently broad to receive a child's foot and movable between an upper, throttling position and a depressed, unthrottling position and positioned in a path of a child approaching the slide entry end so as to normally be stepped on by the child before entering the slide;

a resilient member biasing the panel in the upper position;

a valve body extending transversely from the panel in coplanar relation adjacent the path of entry and having an inlet and an outlet connecting to the hose and the chamber; respectively, a flow control member in the valve body moveable between a throttling and an unthrottling position;

the actuating member being linked to the flow control member to move it to an unthrottling position by the panel being depressed by a child stepping thereon, permitting a maximum water flow to the slide during sliding; and, means for returning the flow control member to the throttling position after a predetermined period of time after stepping off the actuating member corresponding at least to the child reaching the exit end of the slide.

7. A valve according to claim 6 wherein the means for returning the flow control mechanism to the throttling position comprises a resilient member.

8. A valve according to claim 6 wherein the panel comprises a pad of resiliently compressible foam.

9. A valve according to claim 8 wherein the actuating member comprises a flexible strap extending across an upper surface of the foam pad between the flow control member and a remote location of the foam pad for vertical movement from a straight, elevated position to a depressed, curved, unthrottling position with pad depression, by the child stepping on the panel.

10. A valve according to claim 8 wherein the panel comprises a rigid board extending across an upper surface of the foam pad between the flow control member and a remote location for vertical movement from an elevated position to a depressed, unthrottling position with pad depression by the child stepping on the panel.

11. A portable, delayed return, flow control valve for coupling between water using apparatus and a water supply hose and comprising:

a tubular valve body having axially aligned water inlet and water outlet ends;

a flow control member mounted in the valve body between the inlet and the outlet ends for movement from a water flow throttling and a water flow unthrottling position:

an actuating member comprising a step-on, horizontal panel extending transversely away from the valve body, movable from an upper, throttling position to a depressed unthrottling position by stepping thereon and connecting to the flow control member in the depressed position to move it to the unthrottling position;

at least one resilient member biasing at least one of the panel and the flow control member in the throttling position such that the flow control member returns to the throttling position after stepping off the panel.

12. A valve according to claim 11 including means associated with at least one of the panel and the flow control member for delaying return of the flow control member from the unthrottling to the throttling position for a predetermined period after stepping off the panel.

* * * * *